United States Patent [19]

Colson

[11] Patent Number: 5,043,038

[45] Date of Patent: Aug. 27, 1991

[54] METHOD OF MANUFACTURE OF EXPANDABLE AND COLLAPSIBLE SINGLE-PANEL SHADES OF FABRIC

[75] Inventor: Wendell B. Colson, Boulder, Colo.

[73] Assignee: Hunter Douglas Inc., Upper Saddle River, N.J.

[21] Appl. No.: 448,040

[22] Filed: Dec. 8, 1989

[51] Int. Cl.[5] ..... B31C 13/00

[52] U.S. Cl. ..... 156/193; 156/197; 156/204; 156/250; 160/84.1; 428/181

[58] Field of Search ..... 156/65, 191, 193, 197, 156/200, 204, 291, 292, 250; 160/84.1; 428/104, 116, 181, 188

[56] References Cited

U.S. PATENT DOCUMENTS

| | | | |
|---|---|---|---|
| 2,201,356 | 5/1940 | Terrell . | |
| 2,803,578 | 8/1957 | Holland | 156/197 X |
| 2,874,612 | 2/1959 | Luboshez . | |
| 4,288,485 | 9/1987 | Suominen | 428/188 X |
| 4,450,027 | 5/1984 | Colson | 156/193 |
| 4,974,656 | 12/1990 | Tudkins | 160/84.1 |

FOREIGN PATENT DOCUMENTS 6706563 11/1968 Netherlands .

*Primary Examiner*—Michael W. Ball
*Assistant Examiner*—Nancy T. Krawczyk
*Attorney, Agent, or Firm*—Fleit, Jacobson, Cohn, Price, Holman & Stern

[57] ABSTRACT

Single-panel pleated shades are created through an adaptation of methods used to create cellular shades. The cellular shades are created by known methods, and are then cut longitudinally to divide them into two single-panel pleated shades.

Advantages of the invention include its enhanced appearance and low cost.

12 Claims, 6 Drawing Sheets

METHOD OF MANUFACTURE OF EXPANDABLE AND COLLAPSIBLE SINGLE-PANEL SHADES OF FABRIC

FIELD OF THE INVENTION

This invention relates to a method of manufacture of an improved pleated window shade. Specifically, the invention relates to a method of manufacture of an expandable and collapsible material for a single-panel pleated window shade, by cutting in half a cellular window shade consisting of a number of horizontally-extending cells formed of fabric strips adhesively bonded to one another.

BACKGROUND OF THE INVENTION

Several processes are known for manufacturing window shades of folded material. Two basic varieties of these shades of relevance here are as follows. A first, pleated type consists of a single panel of corrugated material. The other is a more complex cellular type, where stacked folded strips form a series of collapsible cells. This latter type is known to have favorable thermal insulation properties, because of the static air mass which is trapped between the layers of material when the cells are in the expanded position. The single-panel type, on the other hand, is favored for its appearance in some cases, and is less expensive to manufacture.

There is considerable difference in the method of manufacture of the single-panel and cellular shades. The former has heretofore been made by repeatedly folding the material across its width, so that it becomes pleated. Among the difficulties with this approach is the need to repeatedly make narrow parallel folds transversely across a wide sheet of material of continuous length. Unless highly exacting conditions are maintained, the folding process can fall out of alignment. Also, substitution of materials is cumbersome because sheets of material and not strips are involved. Further, single-panel shades are relatively weak, structurally, as compared to cellular shades. Retention of pleat shape is a significant problem with most single-panel shades, and is particularly severe where non-woven or sheer fabrics are used. Another disadvantage is the necessity of using multiple sheets joined at seams where large shades are desired.

There are several methods for producing the cellular shades. Most similar to the pleated, single-panel method is the Anderson U.S. Pat No. 4,685,986. This joins together two single-panel pleated lengths of material by adhesively bonding them together at opposing pleats. The adhesive bonding step limits the problem of pleat retention noted above with respect to pleated shades. Other methods depart from the Anderson Patent by joining together series of longitudinally folded strips, rather than continuous sheets of pleated material. Such methods are shown in Colson U.S. Pat. No. 4,450,027, and in Anderson U.S. Pat. No. 4,676,855. In the Colson Patent strips longitudinally folded into a U-shape are adhered on top of one another, whereas in the Anderson Patent these strips are Z-shaped and are adhered in an interlocking position.

The strip joining method shown in the Colson patent has a number of desirable attributes, while providing a highly desirable thermally insulative shade. First, the alignment problems inherent in folding large sheets of material transversely to make pleated shades are largely avoided. Second, substitution of materials is easier because strips and not sheets of material are involved.

Third, structural strength is increased, which gives greater pleat retention and allows for more lightweight materials to be used. Fourth, larger shades can be made without the need for seams. Finally, the speed of production of such cellular shades is at least as fast as that of single-panel pleated shades made by usual methods.

SUMMARY OF THE INVENTION

Accordingly, it is an object of the invention to provide a method of manufacture of "pleated-look" shades of greater strength, and in particular, greater resistance to flattening of the pleats, than heretofore achieved by simply pleating a sheet of material.

It is a further object of the invention to provide such a method which is useful with a wide range of materials, including non-woven and sheer materials.

It is a further object of the invention to provide such a method whereby large shades may be produced without seams.

It is a further object of the invention to provide such a method with rapid production speed and versatile material substitution.

According to the invention a cellular shade structure, particularly as disclosed in the Colson patent discussed above, is created by the methods taught therein. Specifically, an initial creaser assembly is used in which a pair of spaced-apart sharp wheels are pressed into a strip of material to form uniform creases extending longitudinally along the strip. A folding assembly then folds the lateral edges at the creases, over the center portion of the strip, and a press assembly mechanically sets the folds.

Generally, the process is carried out as follows. A drive assembly pulls the material through the folding assembly, and a positive displacement pump feeds a liquid adhesive through an applicator onto the surface of the folded material. The pump is driven from the material drive assembly so that the rate of deposition of the adhesive material on the film is always in direct relation to the rate at which the film moves through the apparatus. Successive lengths of material are stacked in uniform layers on a rotatable stacking bed with flat surfaces where they are adhered together to form the panel structures.

A cutting blade is used to divide the shades lengthwise creating two single-panel shades of equal proportions. Because the cellular method of manufacture is as fast as the traditional pleated shade method, the present invention is nearly twice as fast in producing single-panel shades, while the adhesively bonded strips exhibit excellent pleat retention.

BRIEF DESCRIPTION OF THE DRAWINGS

The invention will be better understood if reference is made to the accompanying drawings, in which.

DESCRIPTION OF THE PREFERRED EMBODIMENTS

As indicated above, single-panel "pleated-look" shades are produced according to the invention by essentially the same methods disclosed in the Colson U.S. Pat. No. 4,450,027, with the additional step of cutting the cellular shade obtained thereby into two essentially identical panels.

Figure 1:
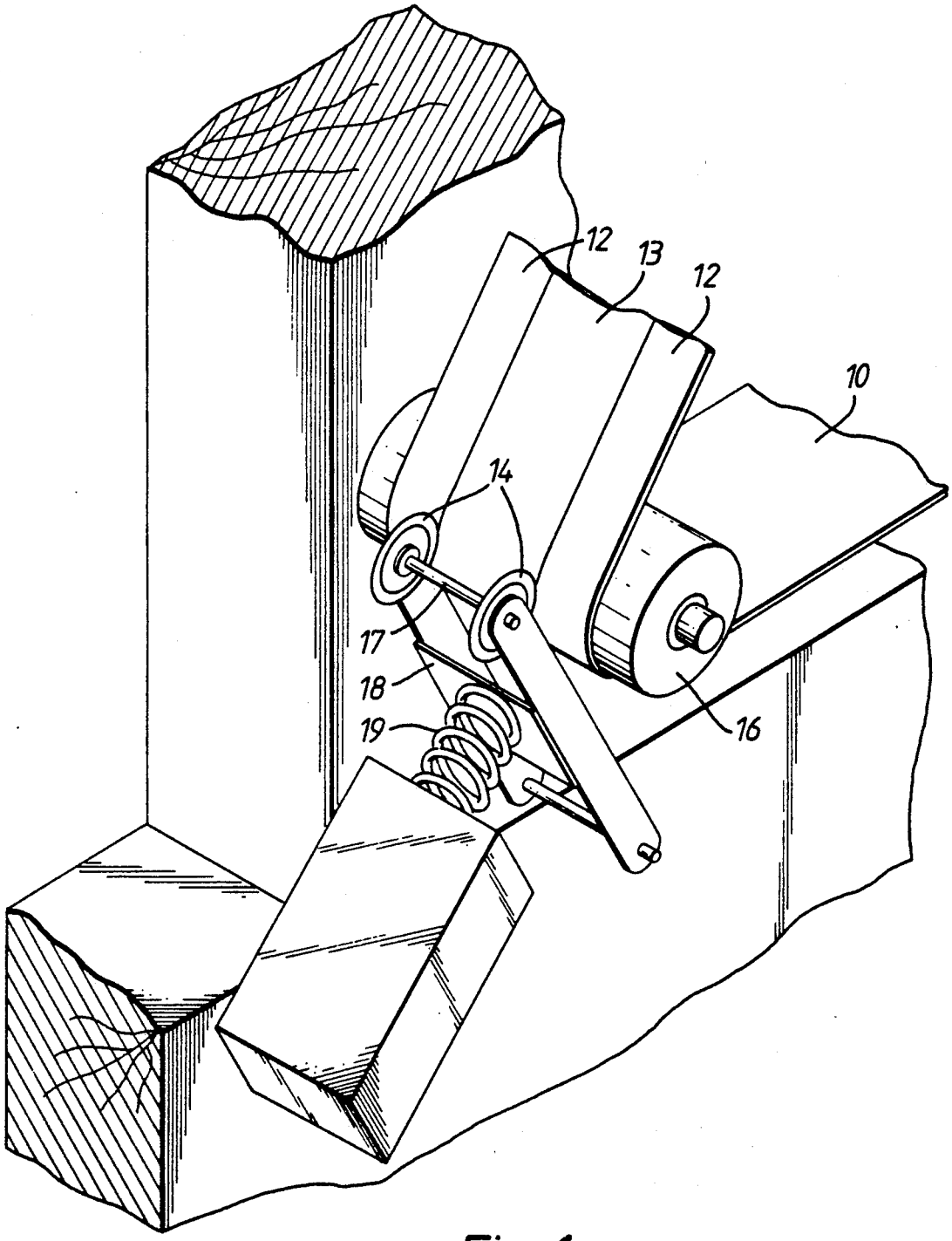
FIG. 1 shows a perspective view of the initial creasing apparatus of the present invention.

FIGS. 1 through 4 illustrate steps used in the basic method for manufacturing cellular shades. A continuous strip of shade material 10 is drawn through a series of steps which result in its edges 12 being folded over the central portion 13, so that they approach each other closely near the middle of the strip. As FIG. 1 shows, a pair of spaced-apart creaser wheels 14 are pressed against the shade material 10 as it is drawn around a roller 16. The creaser wheels are mounted on an axle 17 which is itself mounted on a pivotal arm assembly 18, and are kept pressed against the shade material by a spring 19 which exerts force against the arm assembly.

Figure 2:
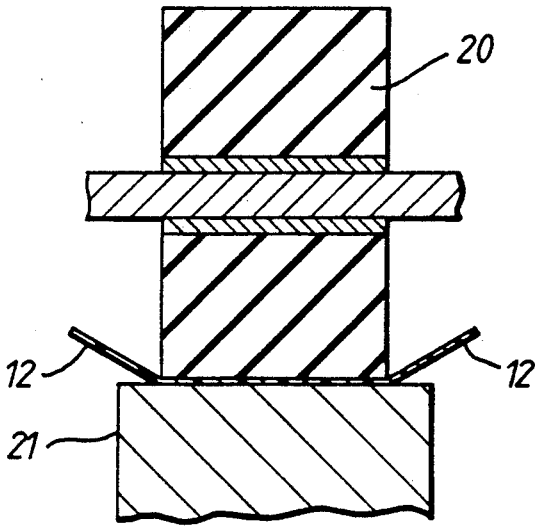
FIG. 2 shows a cross-sectional view of a folding roller as it shapes the shade material.
Figure 3:
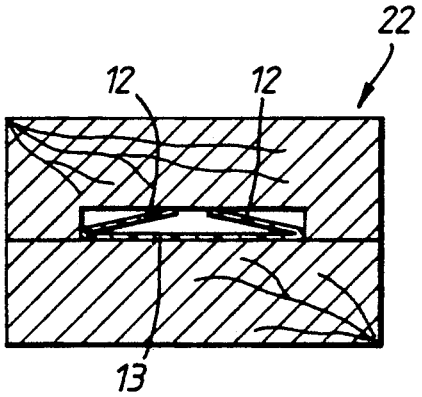
FIG. 3 shows a cross-sectional view of a folding track as it further shapes the shade material.

The initial creasing prepares the shade material for the folding process shown in FIGS. 2 and 3. After creasing, the material 10 is drawn through rollers 20, 21 which are used to bend the edges 12 of the shade material inwardly, as shown in FIG. 2. The edges 12 are then folded in, over the central portion 13 of the shade material 10, by being drawn through a folding die 22, as shown in FIG. 3.

Figure 4:
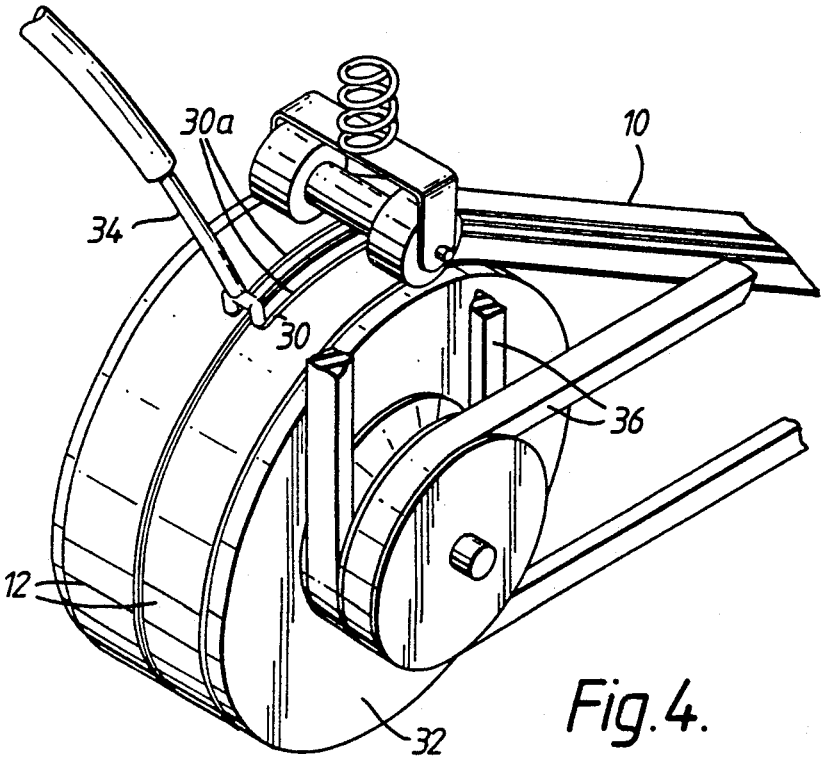
FIG. 4 shows a perspective view of the apparatus for application of adhesive to the shade material.
Figure 5:
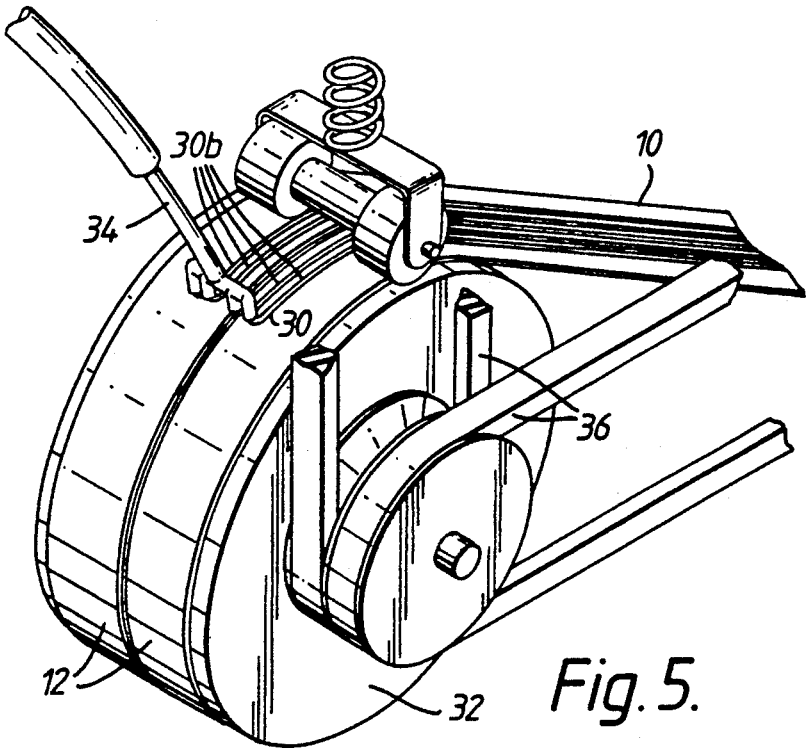
FIG. 5 shows a perspective view of a slightly different apparatus for adhesive application.

Once folded, adhesive material 30 is applied to the shade material, as shown in FIGS. 4 and 5, to bond layers of the shade material together. Generally, as the shade material 10 is drawn around a roller 32, adhesive material 30 is dispensed from an applicator 34 onto the shade material 10. Motor-driven belts 36 may be used to drive the roller 32 to assist in drawing the shade material 10. Preferably, the adhesive 30 is dispensed at a rate proportional to the speed at which the shade material 10 is drawn past, so that a like amount of adhesive 30 is applied regardless of the manufacturing rate.

Figure 9:
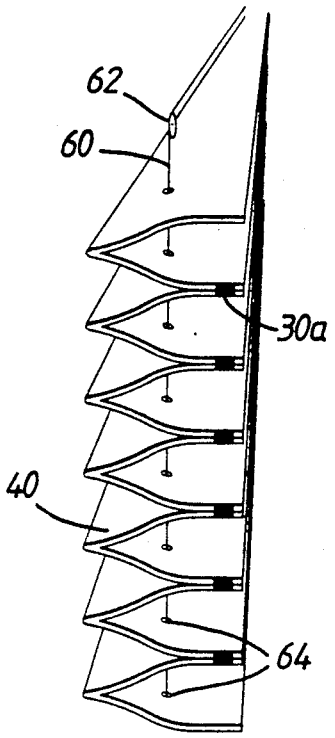
FIG. 9 shows a perspective view of a single-panel shade product according to one embodiment of the invention which is constructed with one line of adhesive.
Figure 10:
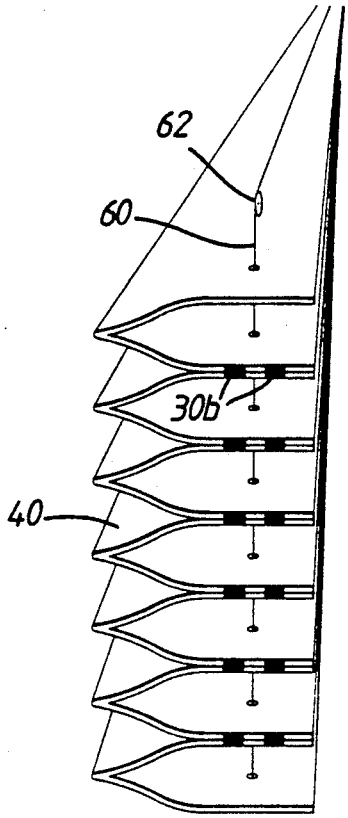
FIG. 10 shows a perspective view of a single-panel shade product according to a second embodiment of the invention which is constructed with two lines of adhesive.

FIGS. 4 and 5 show two preferred modes of adhesive application which result in two different embodiments of the invention shown in FIGS. 9 and 10, respectively. In the FIG. 4 embodiment, two beads 30*a* of adhesive 30 are continuously dispensed one each onto the edges 12 of the shade material 10. The strips of material 10 are then stacked as shown in the Colson patent, so that the strips 10 are bonded to one another. According to the invention, these bonded strips are subsequently cut to create two single-panel shades 40 of the type shown in FIG. 9.

A second embodiment of the invention, varying from that of FIG. 4 in the way in which adhesive 30 is dispensed, is shown in FIG. 5. Instead of the two beads of adhesive, two pairs of parallel beads 30*b* are applied. When the stacked strips are subsequently cut, creating two single-panel shades, those shades are of the type shown in FIG. 10.

As noted above, after the application of adhesive material, the shade material 10 is stacked so that the folded edge portions 12 of one strip are adhesively bonded to the central portion 13 of the next strip. According to the methods disclosed in Colson U.S. Pat. No. 4,450,027, the strip material is wound upon a rotating elongated mandrel. The stacked assembly of strips thus curves around the ends of the mandrel. When the assembly is complete, the curved ends of the assembly are cut off, leaving two shade panels on either side of the mandrel.

Figure 6:
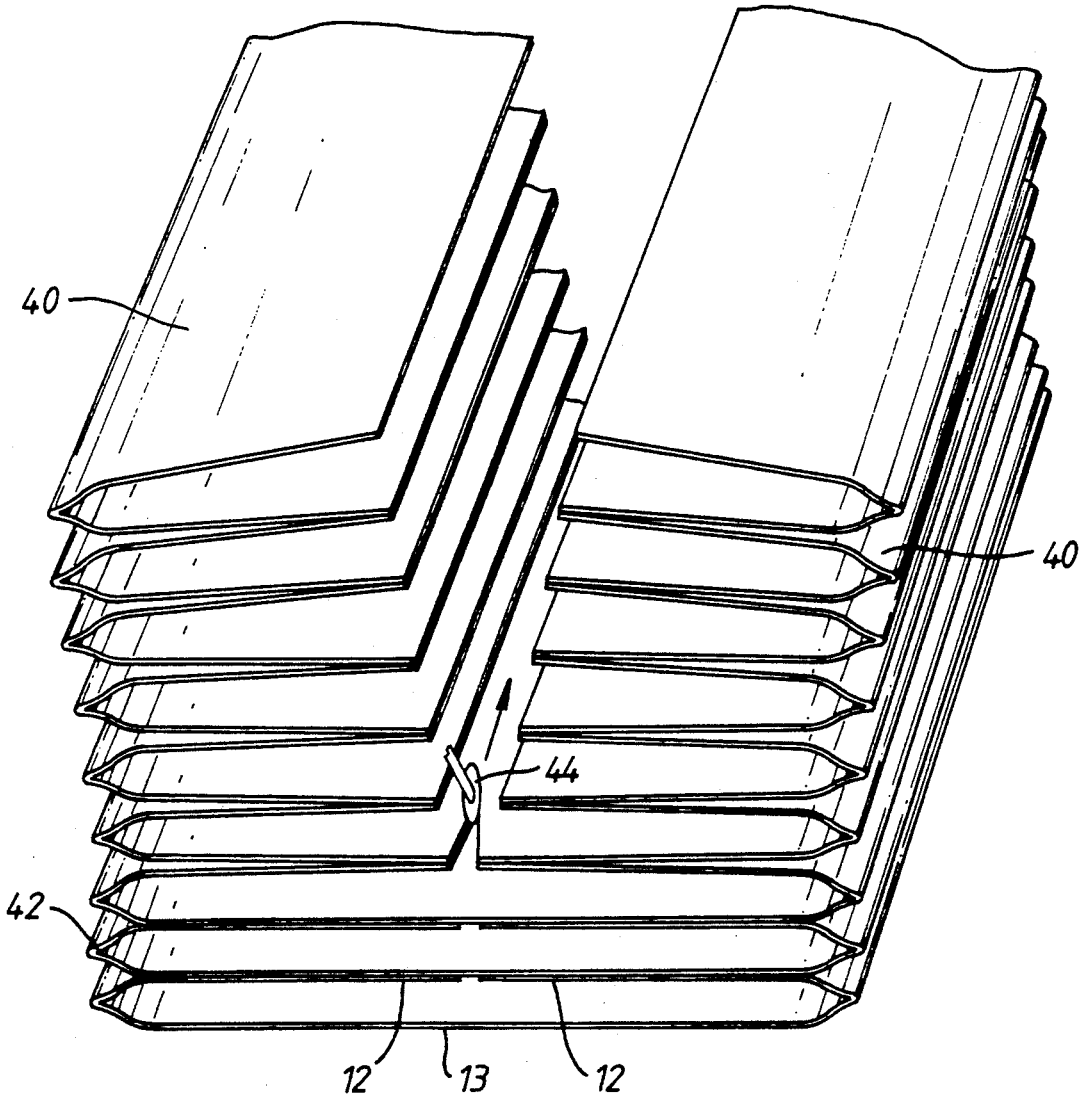
FIG. 6 shows a perspective view of a layered cellular shade being separated into two pleated shade portions according to the present invention.
Figure 7:
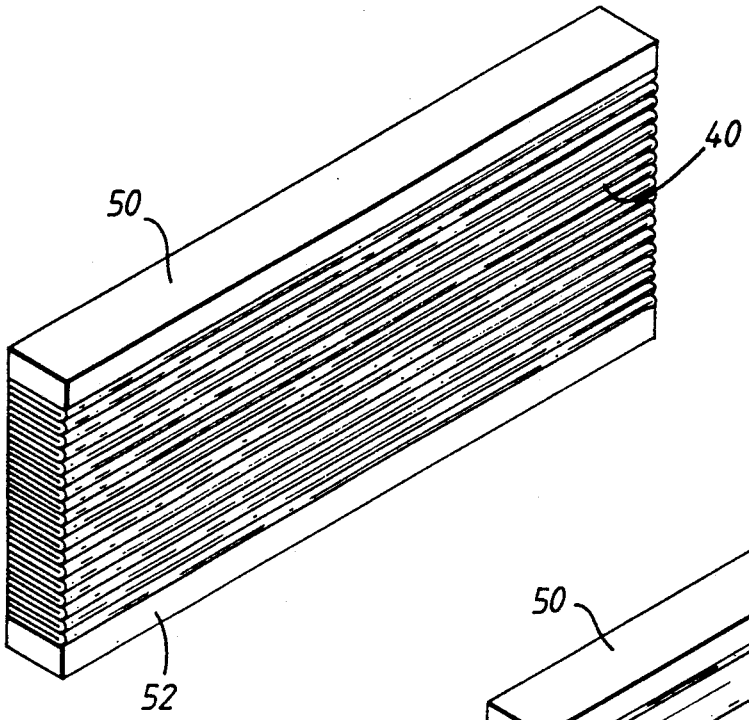
FIG. 7 shows a perspective view of the single-panel shade material according to the present invention in its collapsed state.
Figure 8:
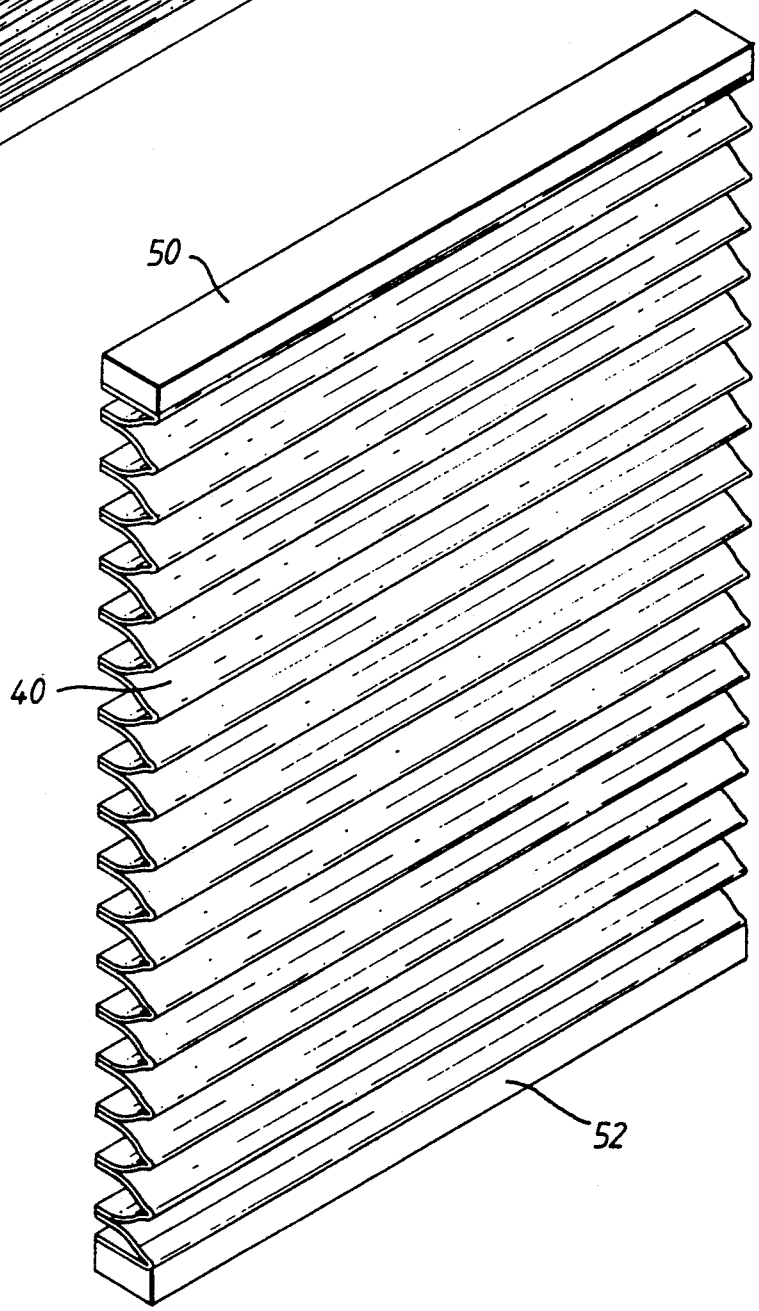
FIG. 8 shows a perspective view of the single-panel shade material according to the present invention in its expanded state.

The present invention adds the additional step of cutting he stacked material longitudinally down its central portion 13, between the folded side portions 12, yielding two pleated panels 40. See FIG. 6. The preferred method of cutting the cellular stack 42 to obtain two panels 40 employs a rotating, circular knife blade 44, as shown in FIG. 6. However, any basic cutting tool could be used, even a simple hand-held knife. These pleated panels are then used in the usual way to make finished shade products. That is, they may be joined to a top slat 50 and a bottom slat 52, as shown in FIGS. 7 and 8, in order to give the panel 40 structural rigidity. Conventional cords 60, pulleys 62, and related hardware, as shown schematically in FIGS. 9 and 10, may be added to provide a means for expanding and contracting the panel 40.

As noted above, in the FIG. 9 embodiment, one bead of adhesive 30*a* is used to bond each strip to the next. Typically, holes 64 are drilled so that the cords 60 for expanding and contracting the shade 40 are visible from the side of the shade meant to face into a room, as shown. In the FIG. 10 embodiment, holes 64 are drilled so that the cords 60 are typically disposed between the beads of adhesive 30*b* provided. In this embodiment, the cords 60 for expanding and contracting the shade 40 are not visible from the side of the shade meant to face into a room.

Figure 11:
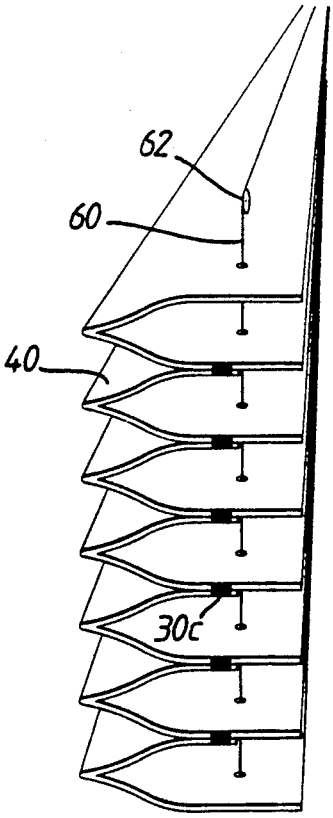
FIG. 11 shows a perspective view of a single-panel shade product according to a third embodiment of the invention which is constructed with one line of adhesive.
Figure 12:
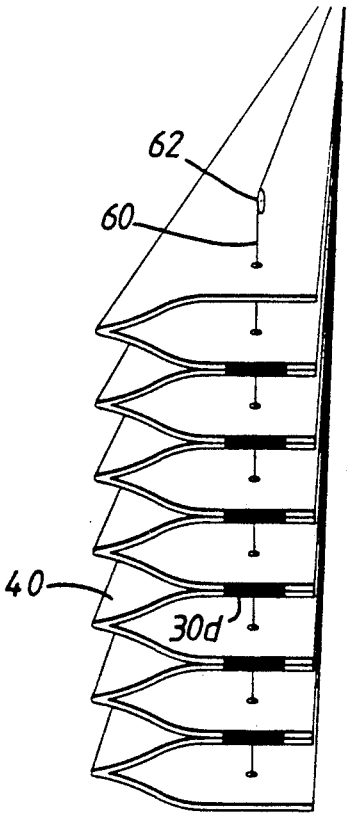
FIG. 12 shows a perspective view of a single-panel shade product according to a fourth embodiment of the invention which is constructed with one line of adhesive.

Two other embodiments representing variations on the manner of adhesive bonding are shown in FIGS. 11 and 12. Both of these use two beads of adhesive dispensed onto the strip of shade material, as in the FIG. 9 embodiment. In the FIG. 11 embodiment, however, the holes 64 for the cords 60 are drilled behind the adhesive bonds 30*c* so that the cords 60 for expanding and contracting the shade 40 are not visible from the side of the shade meant to face into a room. According to the embodiment of FIG. 12, the adhesive bonds 30*d* are relatively wide and the holes 64 for the cords 60 are drilled through the bonds. This also yields a product where the cords are not visible from the side of the shade meant to face into a room.

It should also be noted that the adhesive material used, while usually liquid adhesive, may be of other varieties such as double-sided contact tape.

Finally, while the preferred mode of the invention is to employ the processes disclosed in Colson U.S. Pat. No. 4,450,027, adding the cutting step according to the invention, and including the steps of drilling the assembly for cords and the like at specific locations with respect to the glue bond locations as needed, the invention may be used generally to divide cellular shades produced by other methods to yield two single-panel pleated shades. These other methods include all those employing different ways of creating cellular arrays of folded strips of material which are stacked and bonded to form the shade.

While preferred embodiments of the invention have been disclosed and discussed in detail, they are not to be considered as limitations on the invention, but only exemplary thereof. Accordingly, the invention should not be limited by the above disclosure, but only by the following claims.

I claim:

1. The method of fabricating an expandable shade of a plurality of folded strips, one on top of the other, comprising the steps of:

stacking in layers a continuous folded strip of material having a central portion and two lateral edge portions folded over the central portion to form an assembly of cells one on another;

applying an adhesive material to each layer in at least two parallel adhesive lines to bond the central portion of each layer to the folded lateral edge portions of an adjacent layer, forming a unitary stack; and cutting the section of the stacked folded material longitudinally along the center of the cells between the at least two adhesive lines on each layer to create two single-panel expandable structures.

2. The method of claim 1, where the adhesive material bonds the folded strip in one longitudinal line between each folded lateral edge portion and the central portion of the adjacent layer.

3. The method of claim 2, wherein the step of applying adhesive material comprises applying only one longitudinal adhesive line along each lateral edge portion of the folded material.

4. The method of claim 1, wherein the step of applying adhesive material comprises applying two parallel longitudinal adhesive lines along each lateral edge portion of the folded material.

5. The method of claim 2, further comprising the steps of:

forming holes through the stacked folded material between the adhesive and the location where the material is folded;

attaching a head rail to a top folded strip and a bottom rail to a bottom folded strip; and connecting at least one cord to the bottom rail, extending through the holes in the stacked folded material and into the head rail.

6. The method of claim 2, further comprising the steps of:

forming holes through the stacked folded material between the adhesive and the location where the material is cut;

attaching a head rail to a top folded strip and a bottom rail to a bottom folded strip; and connecting at least one cord to the bottom rail, extending through the holes in the stacked folded material, and into the head rail.

7. The method of claim 2, further comprising the steps of:

forming holes through the stacked folded material, said holes extending essentially through the adhesive material joining the layers;

attaching a head rail to a top folded strip and a bottom rail to a bottom folded strip; and connecting at least one cord to the bottom rail, extending through the holes in the stacked folded material and into the head rail.

8. The method of claim 1, where the adhesive material bonds the folded strip in two parallel longitudinal lines between each folded lateral edge portion and the central portion of the adjacent layer.

9. The method of claim 8, further comprising the steps of:

forming holes through the stacked folded material between the parallel longitudinal lines of adhesive material;

attaching a head rail to a top folded strip and a bottom rail to a bottom folded strip; and connecting at least one cord to the bottom rail, extending through the holes in the stacked folded material and into the head rail.

10. The method of fabricating an expandable shade of a plurality of folded strips, one on top of the other, comprising the steps of:

continuously folding a continuous strip of material having a central portion and two lateral edges so that the lateral edges are folded over the central portion;

applying an adhesive material longitudinally along each folded edge to form at least two parallel adhesive lines;

stacking the continuous strip of folded material in a plurality of adjacent layers one on another with at least two longitudinally extending, parallel adhesive lines positioned between each layer, by wrapping the continuous strip over a rotating mandrel so that the continuous strip forms two or more straight sections connected by curved portions;

allowing the adhesive material to adhere one layer to another to form a unitary stack;

cutting a straight section of the stacked folded material away from the remainder of the stacked material; and cutting the section of the stacked folded material longitudinally between the parallel adhesive lines on each layer, whereby at least one single-panel expandable structure is created without longitudinal cutting through the adhesive material.

11. The method according to claim 1 wherein said cutting is between the folded edge portions, whereby only a single thickness of material is cut for every cell cut to create the two single panel expandable structures.

12. A method for fabricating a single-pleated expandable structure of a plurality of folded strips, one on top of the other, comprising:

fabricating an expandable and collapsible cellular structure having a vertical axis in the direction of expansion and collapse and a horizontal longitudinal axis, said structure comprising a series of stacked and joined collapsible longitudinal cells, said cells being joined by spaced apart, parallel longitudinal adhesive lines; and cutting the shade longitudinally, parallel to the vertical axis and between the spaced apart longitudinal adhesive lines to form at least one single pleated expandable structure.

* * * * *